US006272772B1

(12) United States Patent
Sherman

(10) Patent No.: US 6,272,772 B1
(45) Date of Patent: Aug. 14, 2001

(54) FOOTWEAR SUPPORT SYSTEM

(76) Inventor: Daniel J. Sherman, P.O. Box 3533, Olympic Valley, CA (US) 94146

( * ) Notice: Subject to any disclaimer, the term of this patent is extended or adjusted under 35 U.S.C. 154(b) by 0 days.

(21) Appl. No.: 09/382,271

(22) Filed: Aug. 24, 1999

(51) Int. Cl.[7] ..... A43B 7/20
(52) U.S. Cl. ..... 36/89; 36/91
(58) Field of Search ..... 36/89, 91, 50.1, 36/58.5, 115

(56) References Cited

U.S. PATENT DOCUMENTS 1,328,333 * 1/1920 Mann .
3,327,410 * 6/1967 Park, Sr. et al. .
4,130,949 * 12/1978 Seidel .
4,441,265 * 4/1984 Burns et al. .
4,547,981 * 10/1985 Thais et al. .
4,640,025 * 2/1987 DeRenzo .
4,811,498 * 3/1989 Barret .
5,269,078 * 12/1993 Cochrane .
5,822,887 * 10/1998 Turner .

* cited by examiner

*Primary Examiner*—Ted Kavanaugh
(74) *Attorney, Agent, or Firm*—Skinner, Sutton, Watson & Rounds

(57) ABSTRACT

An apparatus mounted externally on a shoe to allow the wearer to have increased comfort and better support; in particular, relates to an apparatus, method, and system to increase comfort and support in athletic shoes.

4 Claims, 5 Drawing Sheets

FOOTWEAR SUPPORT SYSTEM

BACKGROUND OF THE INVENTION

1. Field of the Invention

This invention relates to an apparatus mounted externally on a shoe to allow the wearer to have increased comfort and better support; in particular, this invention relates to an apparatus, method, and system to increase comfort and support in athletic shoes.

2. State of the Art

There are many types of shoes used in athletic endeavors. Each shoe provides as much support for the foot as possible in order to increase the useful life of the shoe and increase athletic performance. However, to get the best possible performance while protecting the foot against injury, some sort of additional support may be used by the athlete.

This problem may best be described with hockey skates. Leather lace-up hockey skates are inferior to the support offered by plastic molded recreational skates, but exceptional for the comfort and feel hockey players demand. Because of this unwavering demand for comfort, skate manufactures are limited in the rigidity enhancements that can be build into a hockey skate. As the leather "gives" through continual use, the support the skate gives the foot, the comfort level, and the skating ability of the skate decreases. As a result, even the highest quality hockey skate breaks down causing decreased foot stability and loss of confidence in skating performance. Many hockey players resort to taping the skate at the ankles to restore support, which limits essential forward flexion and does nothing to increase effective heel lock.

Therefore, there is a need for better support and comfort in skates which the present invention provides. The present invention is to be used as support for all types of shoes, boots, and skates ranging from basketball, hiking, tennis, and snowboard boots, to ice, and in-line hockey skates. This invention provides for a biometric crisscross pattern foot support system which provides improved athletic performance, extends the shoe's useful life, and provides for the ease of "breaking in" new shoes. Moreover, the crisscross pattern inherently facilitates forward flexion while markedly increases effective heel lock and overall stability.

SUMMARY OF THE INVENTION

This invention, a footwear support system, provides for an apparatus, method, and system to increase comfort, support, and useful life of shoes, boots, and skates.

A first aspect of this invention comprises:

a shoe having an ankle, an arch, a front surface, and a sole;

a first strap member having a first side, a second side, a first pass-through buckle and a first free end; the first strap member securing the arch;

a second strap member having a first side, a second side, a second pass-through buckle and a second free end; the second strap member securing the ankle; and the first strap member and the second strap member securing the front surface in a crisscross pattern.

Another embodiment of this invention, a footwear support system is:

a shoe having an ankle, an arch, and a front surface;

a first mating strap member attached to the arch;

a second mating strap member attached to the ankle;

a first attachment means attached to the arch for attaching with the second mating strap member; and a second attachment means attached to the ankle for attaching with the first mating strap member.

A second aspect of this invention provides for a method of protecting and supporting a foot comprising:

securing a first strap member on a first side to a sole of a shoe;

securing a second strap member on a first side to an ankle of the shoe;

inserting a first free end of the first strap member through a second pass-through buckle on the second strap member;

tightening the first strap member and mating a first mating member with a first attachment means on a second side of the first strap member;

inserting a second free end of the second strap member through a first pass-through buckle on the first strap member;

tightening the second strap member and mating a second mating member with a second attachment means on a second side of the second strap member.

Still another method of protecting and supporting a foot comprises:

passing a first mating strap member through a second attachment means;

passing a second mating strap member through a first attachment means;

tightening and securing the first mating strap member into the second attachment means; and tightening and securing the second mating strap member into the first attachment means.

A third aspect of this invention further provides a system for protecting and supporting a foot comprising:

a shoe having an ankle, an arch, a front surface, and a sole;

a first strap member having a first side, a second side, a first pass-through buckle and a first free end;

a second strap member having a first side, a second side, a second pass-through buckle and a second free end;

the first strap member having a first mating member proximate the first free end and a first attachment means for attaching with the first mating member proximate the first pass-through buckle; the first attachment means and the first mating member disposed on the second side of the first strap member;

the second strap member having a second mating member proximate the second free end and a second attachment means for attaching with the second mating member proximate the second pass-through buckle; the second attachment means and second mating member disposed on the second side of the second strap member;

securing the first side of the first strap member to the sole;

securing the first side of the second strap member to the ankle;

inserting the first free end of the first strap member through the second pass-through buckle;

inserting the second free end of the second strap member through the first pass-through buckle;

tightening the first strap member and attaching the first mating member with the first attachment means;

tightening the second strap member and attaching the second mating member with the second attachment means; and forming an X on the front surface of the shoe with the first strap member and the second strap member.

Still another system for protecting and supporting a foot, comprises:

a shoe having an ankle, an arch, and a front surface;

a first mating strap member attached to the arch;

a second mating strap member attached to the ankle;

a first attachment means attached to the arch member for attaching with the second mating strap member;

a second attachment means attached to the ankle for attaching with the first mating strap member;

the first mating strap member and the first attachment means are disposed at opposite sides of the arch;

the second mating strap member and the second attachment means are disposed at opposite sides of the ankle;

passing the first mating strap member through the second attachment means;

passing the second mating strap member through the first attachment means;

tightening and securing the first mating strap member into the second attachment means;

tightening and securing the second mating strap member into the first attachment means; and forming an X on the front surface with the first mating strap member and the second mating strap member.

DETAILED DESCRIPTION OF THE PREFERRED EMBODIMENT

Figure 2:
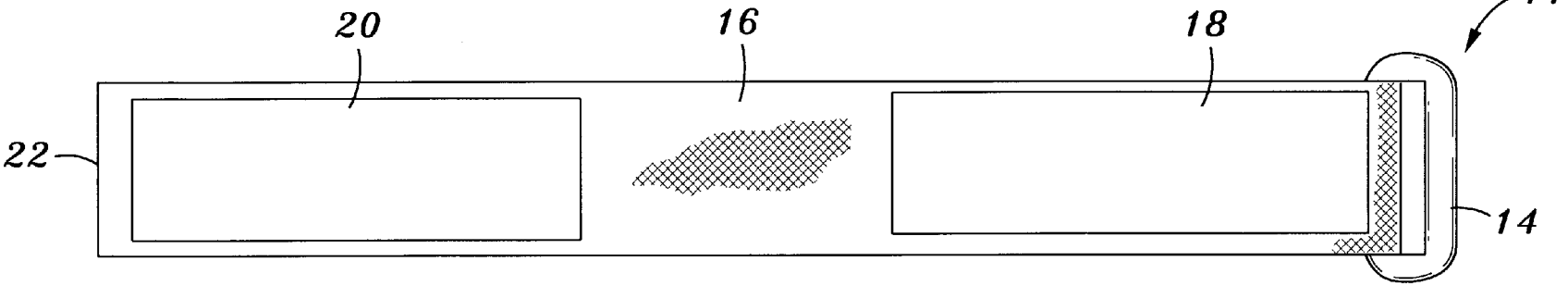
FIG. 2 shows a second side of one of the strap members.
Figure 1:
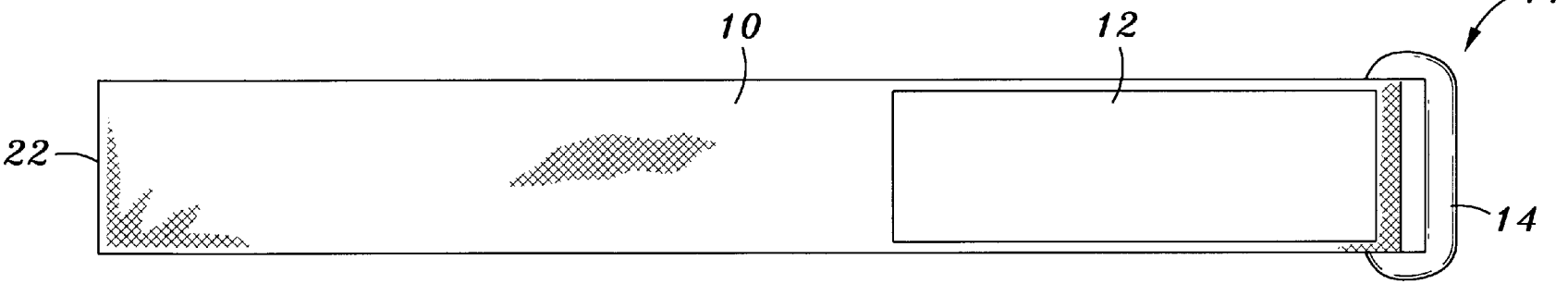
FIG. 1 shows the first side of one of the strap members.
Figure 3:
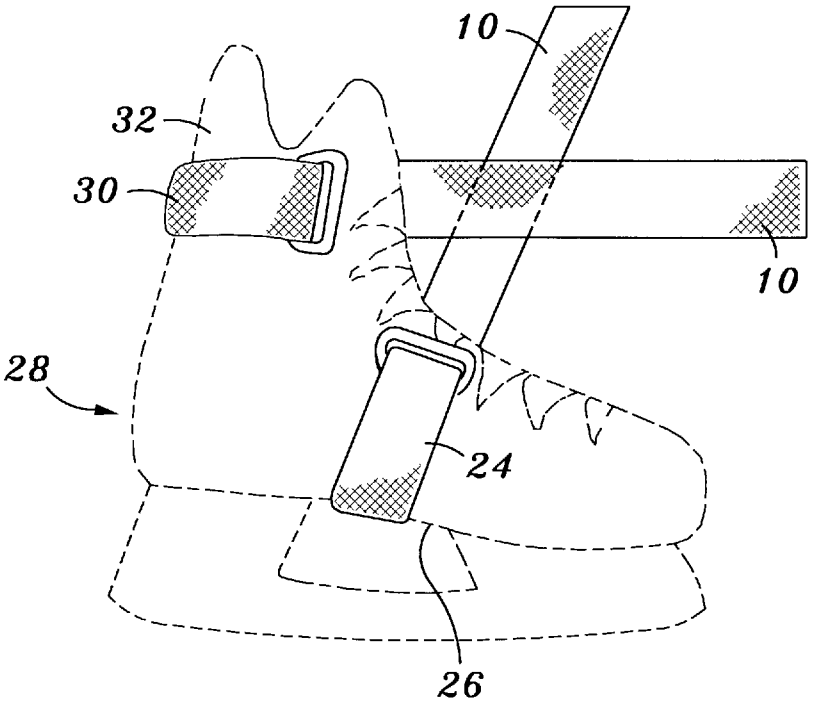
FIG. 3 shows a perspective view of the preferred embodiment and the placement of the strap members.

The foot support system, in a preferred embodiment, is composed of two strap members which are substantially similar. It should, of course, be realized that this invention is not restricted to the first and second members being the same. FIG. 1 and FIG. 2 illustrates only one of the strap members. FIG. 1 shows the first side 10 of the strap member, generally referred to as 11. The first side has a first attachment means 12 proximate the pass-through buckle 14. The attachment means 12 is to attach with either a first mating member on the sole of the shoe or a second mating member on the ankle of the shoe, as shown in FIG. 3. Referring to FIG. 2, the second side 16 of the strap member 11, a second attachment means 18 is disposed proximate the pass-through buckle 14 and a third mating member 20 is disposed proximate the free end 22. The second attachment means 18 is to attach with the third mating member 20.

Figure 8:
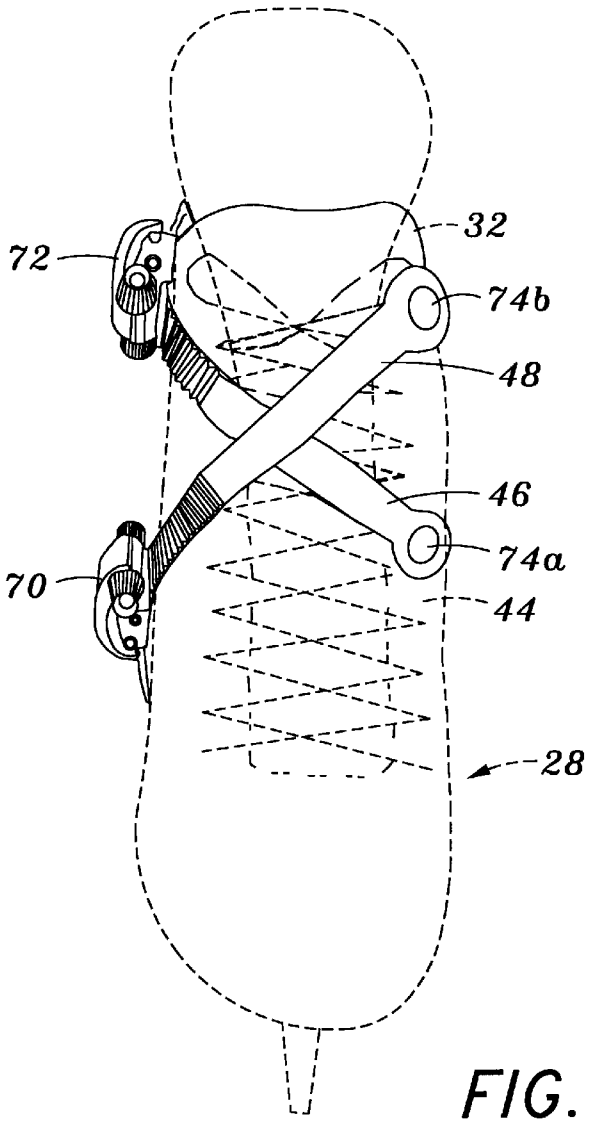
FIG. 8 shows still another preferred embodiment of the present invention.

It is preferable that the attachment means and mating member be hook and loop material, which is well known in the art. However, the attachment means and mating member may be material such as adhesive, snap-on buttons, rivets, any other compression joinable material, or other such similar materials. Moreover, the pass-through buckle is not limited to being a pass-through buckle. The buckle may be similar to a standard belt buckle, or any other means which to secure the strap member, one example of which is shown in FIG. 8.

Now referring to FIG. 3, the first strap member 24 is secured to the sole 26 of the shoe 28 on a first side 10. The second strap member 30 is secured to the ankle 32 of the shoe 28 on a first side 10. The first attachment means 12 (shown in FIG. 1) on the straps 24 and 30 are to attach with mating member on the sole 26 and ankle 32 of the shoe, respectively. It is preferable that the attachment means and mating member be hook and loop material, which is well known in the art. However, the attachment means and mating member may be material such as adhesive, snap-on buttons, rivets, any other compression joinable material, or other such similar materials.

Figure 4:
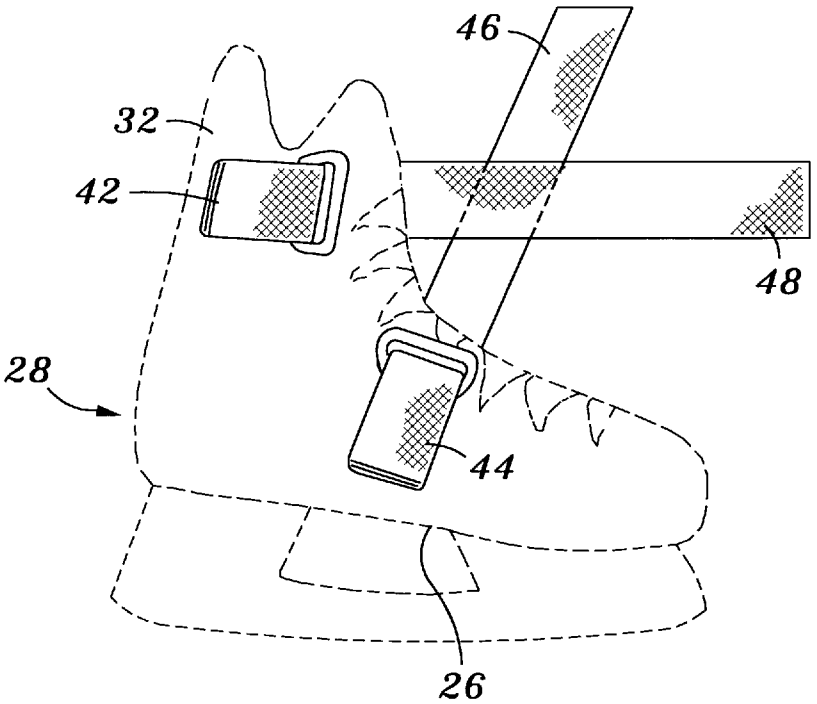
FIG. 4 shows a perspective view of another preferred embodiment and the placement of the strap members.
Figure 5:
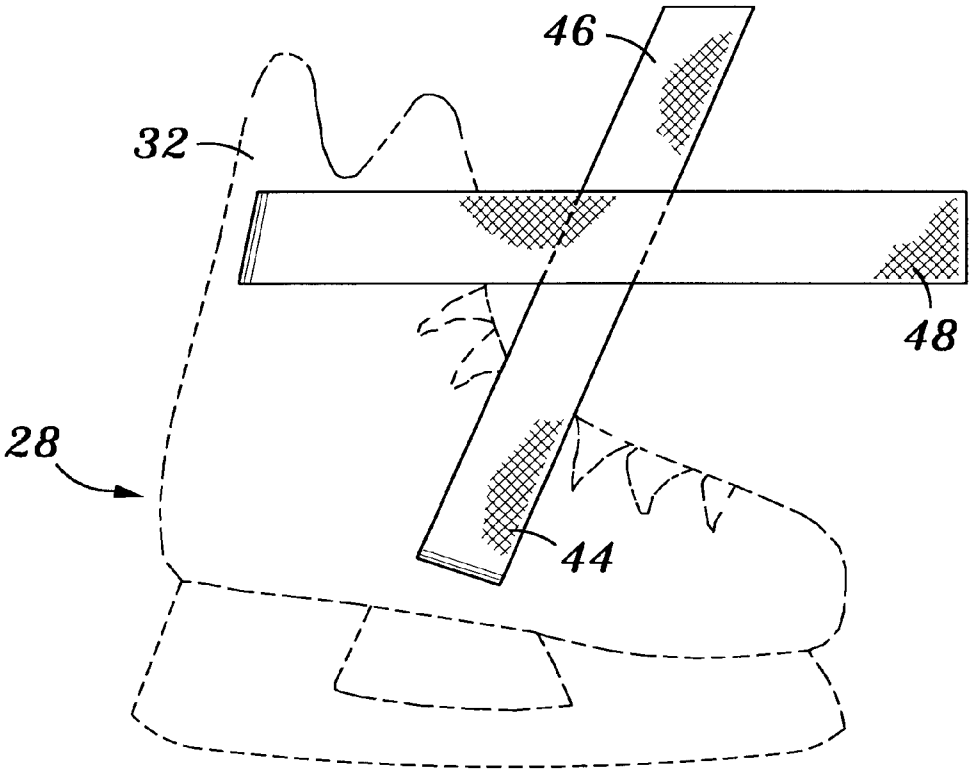
FIG. 5 shows the opposite side of FIG. 4 to further illustrate placement of the strap members.

In another preferred embodiment, as shown in FIG. 4 and FIG. 5, the strap members may be attached directly to the shoe 28. In FIG. 4, a first attachment means 40 and a second attachment means 42 is attached directly on the arch 44 and ankle 32 of the shoe, respectively. On the opposite side of the arch and ankle of the shoe, as shown in FIG. 5, is a first mating strap member 46 and a second mating strap member 48, respectively. The first mating strap member 46 is to mate with the second attachment means 42 and the second mating strap member 48 is to mate with the first attachment means 42. Although it is preferred that the mating strap members and the attachment means be sewn onto the shoe, other attachment means such as adhesives, snap-on buttons, rivets, any other compression joinable material, or other such similar materials may be used to securely attach the mating strap members and the attachment means onto the shoe.

Figure 6:
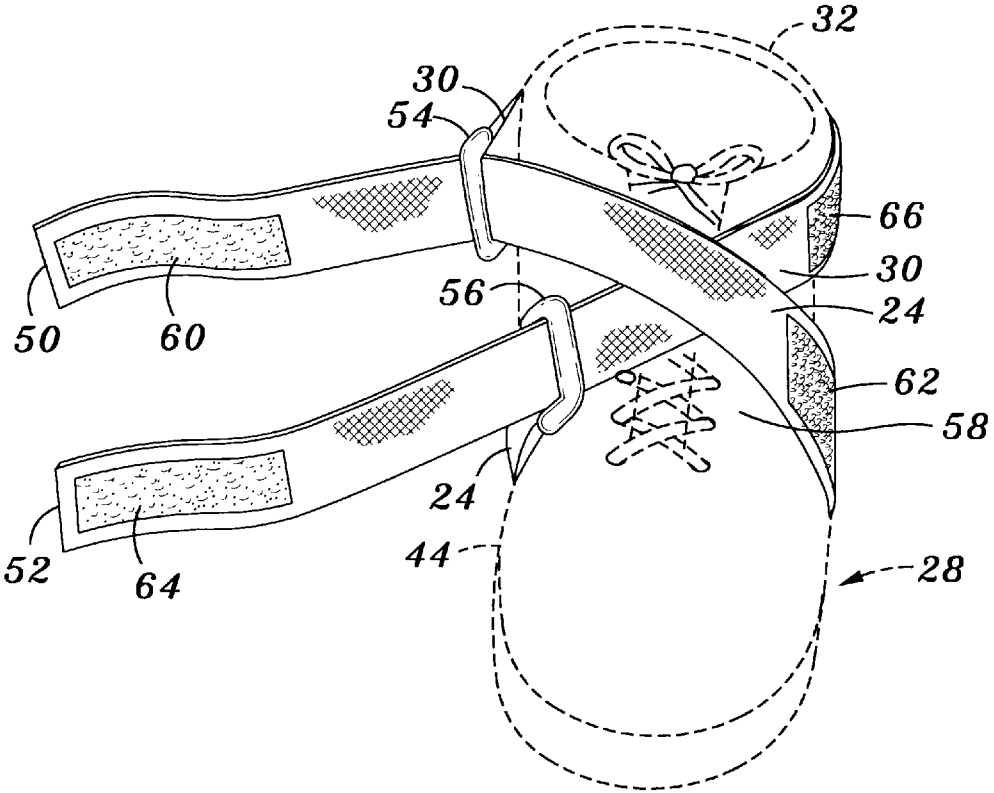
FIG. 6 shows the disposition of the strap members after being placed onto the shoe.

Once the strap members are securely attached to the shoe, the first free end 50 of the first strap member 24 is dispose through the second pass-through buckle 54 on the second strap member 30, as shown in FIG. 6. The second free end 52 of the second strap member 30 is disposed through the first pass-through buckle 56 on the first strap member 24. This forms a crisscross, or X, on the front surface 58 of the shoe 28. The first strap member 24 is to provide support for the arch 44 of the shoe 28 and the second strap member 30 provides support for the ankle 32 of the shoe 28. Furthermore, the crisscross provides further support for the front surface 58 of the shoe 28.

Figure 7:
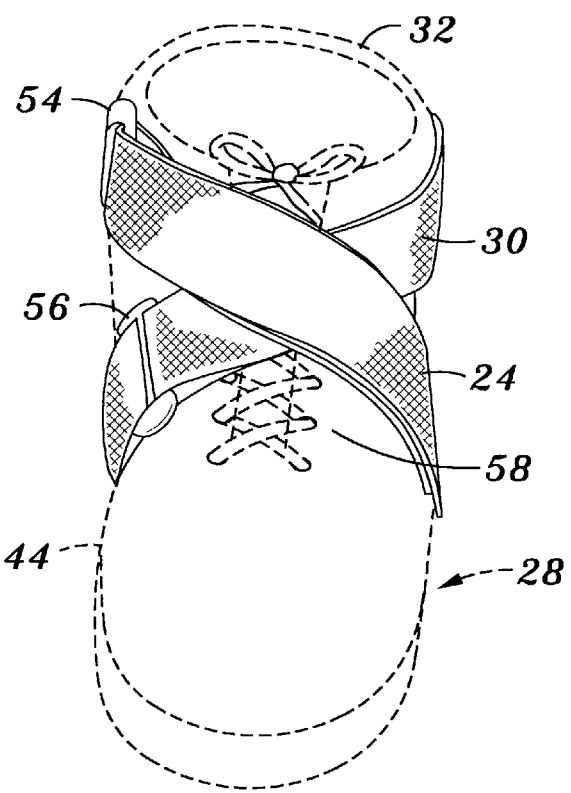
FIG. 7 shows a front view of the invention when completely and securely strapped onto a shoe.

To complete the footwear support system as shown in FIG. 7, the mating member 60 on the first strap member 24 mates with the attachment means 62 on the first strap member 24. The mating member 64 on the second strap member 30 mates with the attachment means 66 on the second strap member 30. This provides for the support of the ankle, arch, heel, and front surface of a foot of a wearer.

It should be noted that FIG. 3 shows the use of the footwear support system on a skate, and FIG. 6 shows the use of the footwear support system on a regular shoe. This invention may be used on a variety of shoes, boots, and skates. From basketball, hiking, and tennis shoes to snowboard boots, to ice, and in-line hockey skates. This invention provides for a biometric crisscross pattern foot support system which provides support for the arch and ankle of the foot while increasing effective heel lock and overall stability in all types of shoes.

Moreover, the strap members are not limited to the use of a pass-through buckle and the attachment means and mating member as described above. As shown in FIG. 8, the strap members may comprise of an interlocking means. The first mating strap member 46 and the second mating strap member 48 are attached directly on the arch 44 and ankle 32 of the shoe, respectively. On the opposite side of the arch 44 and ankle 32 of the shoe is a first interlocking means 70 and a second interlocking means 72, respectively. As further shown in FIG. 8, the strap members may be attached to the shoe with the use of a compression joinable material such as rivets 74*a* and 74*b*. However, the straps may also be attached to the shoe with the use of adhesive, snap-on buttons, any other compression joinable material, or other such similar materials.

This invention further provides for a method of protecting and supporting a foot. The wearer is to first secure the first strap member to the sole of the shoe and secure the second strap member to the ankle of the shoe, as shown in FIG. 3. The first free end of the first strap member is then passed through the pass-through buckle of the second strap member and the second free end of the second strap member is then passed through the pass-through buckle of the first strap member, as shown in FIG. 6. The first strap member and the second strap member thereby form a crisscross or an X on the front surface of the shoe. The wearer is to then securely tighten the first strap member and attach the mating member of the first strap member with the attachment means of the first strap member, as shown in FIG. 7. The second strap member is then securely tightened, and the mating member of the second strap member is attached to the attachment means of the second strap member, as shown in FIG. 7.

In yet another method for protecting and supporting a foot, a first mating strap member is passed through a second attachment means and a second mating strap member is passed through a first attachment means, as shown in FIG. 8. This forms a crisscross or an X on the front surface of the shoe. The first mating strap member is then pulled tightly enough to support the arch of the foot and secured into the second attachment means. The second mating strap member is then pulled tightly enough to support the ankle of the foot and secured into the first attachment means.

This invention further provides for a system of protecting and supporting a foot. The first embodiment comprises of two strap members. Both strap members comprise of a free end, a pass-through buckle, and a first attachment means on the first side. The second side comprises a first mating member proximate the free end and a second attachment means for attaching with the mating member proximate the pass-through buckle. It is preferred that the first and second strap members share a substantially similar structure, however, it should be realized that the invention is not restricted to the first and second members being the same.

In use, the first side of the first strap member is attached to the sole of a shoe. It is preferred that the sole of the shoe have a mating member to attach with the attachment means on the first side of the first strap member. The first side of the second strap member is attached to the ankle of the shoe. It is preferred that the ankle of the shoe have a mating member to attach with the attachment means on the first side of the second strap member. The free end of the first strap member is then passed through the pass-through buckle of the second strap member and the free end of the second strap member is then passed through the pass-through buckle of the first strap member. The first strap member and the second strap member therefore form a crisscross, or an X, on the front surface of the shoe.

The wearer then tightens the first strap member enough to allow for enough support of the foot and the first mating member and the second attachment means on the second side of the first strap member are then mated together. The wearer then tightens the second strap member enough to allow for enough support of the foot and the first mating member and the second attachment means on the second side of the second strap member are then mated together. The system for supporting and protecting the foot is complete, as shown in FIG. 7. The crisscross pattern of the footwear support system inherently facilitates forward flexion while increasing heel lock, ankle support, arch support, and overall stability of the foot while in the shoe.

It is preferred that the attachment means and mating member be hook and loop material that is well known in the art. However, the attachment means and the mating member may be adhesives, snap-on buttons, any other compression joinable material, or other such similar materials. Moreover, the strap members are not limited to the use of a pass-through buckle as in FIG. 3. The pass-through buckle may be the belt-type buckles that are well known in the art or any type of interlocking systems as shown in FIG. 8.

Moreover, in another preferred embodiment, the strap members are attached to the shoe, as shown in FIG. 4 and FIG. 5. This embodiment has a first mating strap member attached to the arch, a second mating strap member attached to the ankle, a first attachment means attached to the arch, and a second attachment means attached to the ankle. The first mating strap member and the first attachment means are attached on opposite sides of the arch and the second mating strap member and the second attachment means are attached on opposite sides of the ankle.

In use, the first mating strap member is passed through the second attachment means and the second mating strap member is passed through the first attachment means. The wearer is to then tighten the first mating strap member into the second attachment means enough to provide the necessary support as well as tighten the second mating strap member into the first attachment means enough to provide the necessary support. Therefore, a crisscross is formed with the first mating strap member and the second mating strap member.

This invention has been described by reference to specific embodiments and examples thereof. Variations, modifications, and alterations of these embodiments and examples will suggest themselves to those of ordinary skill in this art. Therefore, the claims appended hereto are intended to encompass as such variations, modifications and alterations.

We claim:

1. A footwear support system, comprising:

a shoe having an ankle, an arch, a front surface, and a sole;

a first strap member having a first side, a second side, a first pass-through buckle and a first free end; the first strap member secured to the arch on the first side and securing the arch;

a second strap member having a first side, a second side, a first pass-through buckle and a second free end; the second strap member secured to the ankle on the first side and securing the ankle; and the first free end disposed through the second pass-through buckle and the second free end disposed through the first pass-through buckle such that the first strap member and the second strap member form an X on the front surface.

2. The footwear support system of claim 1, wherein the first strap member further comprises a first mating member proximate the first free end and a first attachment means for attaching with the first mating member proximate the first pass-through buckle; the first attachment means and the first mating member disposed on the second side of the first strap member; and the second strap member further comprises a second mating member proximate the second free end and a second attachment means for attaching with the second mating member proximate the second pass-through buckle, the second attachment means and the second mating member disposed on the second side of the second strap member.

3. A footwear support system, comprising:

a shoe having an ankle, an arch, and a front surface;

a first mating strap member attached to the arch;

a second mating strap member attached to the ankle;

a first attachment means attached to the arch for attaching with the second mating strap member;

a second attachment means attached to the ankle for attaching with the first mating strap member;

first mating strap member and the first attachment means disposed at opposite sides of the arch;

the second mating strap member and the second attachment means disposed at opposite sides of the ankle;

the first mating strap secured within the second attachment means;

the second mating strap secured within the first attachment means; and wherein the first mating strap member and the second mating strap member form an X on the front surface.

4. A system for protecting and supporting a foot, comprising:

a shoe having an ankle, an arch, and a front surface;

a first mating strap member attached to the arch;

a second mating strap member attached to the ankle;

a first attachment means attached to the arch member for attaching with the second mating strap member;

a second attachment means attached to the ankle for attaching with the first mating strap member;

the first mating strap member and the first attachment means disposed at opposite sides of the arch;

the second mating strap member and the second attachment means disposed at opposite sides of the ankle;

the first mating strap member passing through the second attachment means;

the second mating strap member passing through the first attachment means;

the first mating strap member secured to the second attachment means;

the second mating strip member secured to the first attachment means; and the first mating strap member and the second mating strap member forming an X on the front surface of the shoe.

* * * * *